US006634501B2

(12) United States Patent
Su et al.

(10) Patent No.: US 6,634,501 B2
(45) Date of Patent: Oct. 21, 2003

(54) HANG TAG FOR SOCKETS

(75) Inventors: Wen-Huei Su, Taipei (TW); Fu-Lung Ko, Taipei (TW)

(73) Assignee: Test Rite International Company, Ltd. (TW)

( * ) Notice: Subject to any disclaimer, the term of this patent is extended or adjusted under 35 U.S.C. 154(b) by 0 days.

(21) Appl. No.: 10/121,585

(22) Filed: Apr. 15, 2002

(65) Prior Publication Data

US 2003/0136039 A1 Jul. 24, 2003

(30) Foreign Application Priority Data

Jan. 22, 2002 (TW) ..... 91200563 U

(51) Int. Cl.[7] ..... B65D 73/00
(52) U.S. Cl. ..... 206/378; 206/1.5; 40/673
(58) Field of Search ..... 206/372, 373, 206/476, 1.5; 215/286; 40/673

(56) References Cited

U.S. PATENT DOCUMENTS

| | | | | | |
|---|---|---|---|---|---|
| 5,373,953 | A | * | 12/1994 | Fenton et al. | 215/228 |
| 5,425,519 | A | * | 6/1995 | Budert | 248/214 |
| 5,498,333 | A | * | 3/1996 | Canther | 210/198.1 |
| 5,740,911 | A | * | 4/1998 | Chou | 206/378 |
| 6,032,797 | A | * | 3/2000 | Kao | 206/378 |
| 6,273,255 | B1 | * | 8/2001 | Rosler | 206/378 |

* cited by examiner

*Primary Examiner*—Cassandra H. Davis
(74) *Attorney, Agent, or Firm*—Bacon & Thomas, PLLC

(57) ABSTRACT

A hang tag for sockets. The hang tag includes a hanging card portion having a hanging hole. A neck portion is joined underneath the hanging card portion. A screw-joining portion is joined underneath the neck portion, which has a screw-thread structure screwed to the socket, resulting in the entire hang tag for sockets being able to be displayed and secured by the screw-thread structure of the screw-joining portion. The neck portion is able to be clamped onto by wrenches or other similar tools, and the sockets that can easily be joined onto and removed from the screw-thread socket.

10 Claims, 5 Drawing Sheets

HANG TAG FOR SOCKETS

BACKGROUND OF THE INVENTION

1. Field of the Invention

This invention relates to a hang tag for sockets, which can be used to hang sockets in order to display or sell sockets. The hang tag also has the distinguishing characteristic that it can easily join to or detach from the socket.

2. Description of the Prior Art

For the purpose of selling sockets of specific sizes, sockets are conventionally joined to the hang tag. This hang tag can be hooked to or hung on display racks in order to display or sell sockets. In addition, consumers also can repeatedly use this hang tag for hanging and storing after purchasing the same.

Moreover, the conventional hang tag 3 shown in FIG. 11 is comprised of the hanging card portion 30*o*, the neck portion 32 and the joining portion 33; wherein a hanging hole 31 is located on the hanging card portion 30, so that the conventional hang tag 3 can be hung on the display rack; the neck portion 32 is joined underneath the hanging card portion 30; the joining portion 33, joined underneath the neck portion 32, is comprised of a plurality of parallel ring bodies. Thus, the separately sold socket 20 can be joined to the joining portion 33; with the hanger tag 3 linked to the socket 20, and the sockets can be displayed and sold in this manner.

The joining portion 33 of the hang tag 3 is comprised of a plurality of parallel ring bodies. The outer diameters of the ring bodies are larger than that of the socket 20, so that by means of friction through an interference fit, the socket 20 can be directly pressed and inserted toward the jointing portion 33 to be integrally joined.

Nevertheless, joining the socket 20 and the joining portion 33 requires tremendous force by users; moreover, it is also burdensome for consumers to detach the socket 20 from the joining portion 33 of the hang tag 20 after purchase.

Thus, as the joining portion 33 of the hang tag 3 is comprised of a plurality of parallel ring bodies, easily and conveniently attaching and detaching the socket 20 is not possible with the conventional hang tag design. There obviously is a drawback that needs improvement.

SUMMARY OF THE INVENTION

The main object of the invention is to provide a hang tag for sockets, comprised of a hanging card portion with a hanging hole, and the screw-joining portion formed underneath the hanging card portion. The socket is to be joined through the screw-thread structure of the screw-joining portion, enabling the socket to be easily screwed onto the screw-joining portion, and the socket can also be easily detached from the screw-joining portion.

The other object of the invention is to provide a hang tag for sockets comprised of a neck portion having at least a pair of parallel sides. The parallel sides are provided for easy clamping onto by wrenches or other similar tools. In this way, the socket is much easier to be attached or detached using wrenches and other similar tools.

The screw-thread structure of the screw-joining portion can be a single screw-thread, double screw-threads or quadruple-screw thread structure.

The screw-thread structure of the screw-joining portion can be a gapped structure formed by a set of discontinuous threads.

The shape of the neck portion can be hexagonal, tetragonal, octagonal or oval with a pair of parallel sides.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENTS

Figure 1:
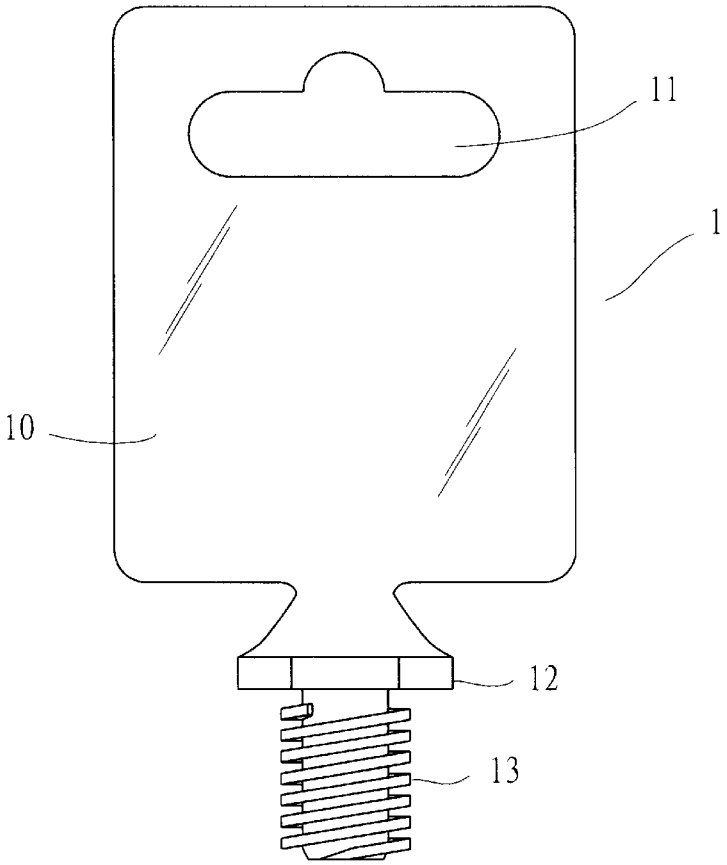
FIG. 1 is a front structural view of the hang tag according to this invention.
Figure 2:
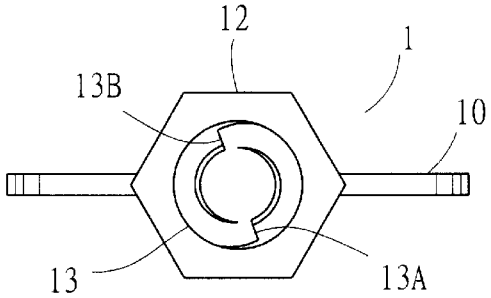
FIG. 2 is a bottom structural view of the hang tag according to this invention, illustrating that the screw thread of the screw-joining portion is double screw thread.
Figure 3:
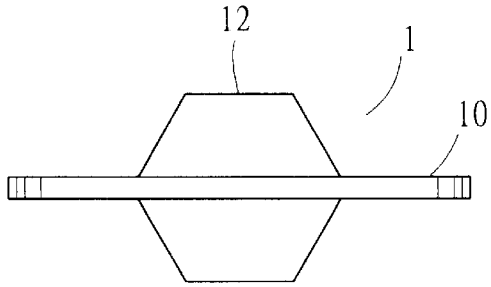
FIG. 3 is a top plan structural view of the hang tag according to this invention, illustrating that the shape of the neck portion is hexagonal.

Please refer to FIG. 1, FIG. 2 and FIG. 3. The hang tag 1 of the invention is comprised of a hanging card portion 10 with hanging hole 11, a neck portion 12 which is joined underneath the hanging card portion 10 and which includes at least a pair of parallel sides. The shape of the neck portion 12 is, for example, hexagonal, and a screw-jointing portion 13 having a screw thread structure, for example, double screw threads, is joined underneath the neck portion 12.

Figure 4:
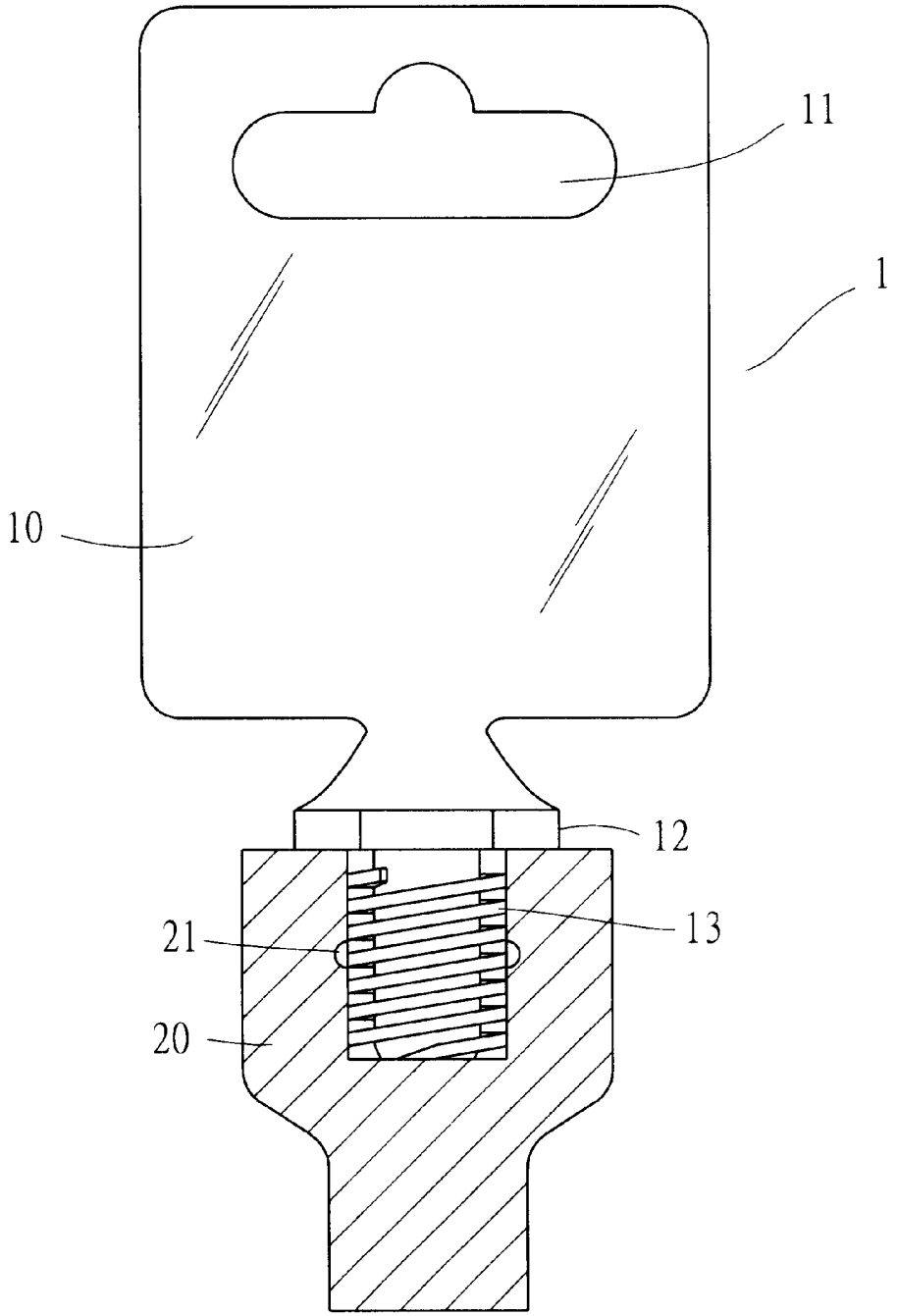
FIG. 4 is a cross sectional view of the hang tag which is joined with the socket.

As shown in FIG. 4, the hanging hole 11 enables the hang tag 1 to be hung on a display rack; the outer diameter of the screw-joining portion 13 is greater than the diameter of the socket 20. Thus, the socket 20 can be easily screwed and joined to the screw-joining portion 13 integrally by means of the channeling function provided by the concave portion 21 installed on the socket 20 (such a concave portion in a socket is an existing design for the elastic body of a wrench to interlock thereon, thus the socket and the wrench can be joined); In the same way, the socket 20 can also be screwed off and detached from the screw-joining portion 13 with ease. The neck portion 12 can be clamped onto by wrenches or the other similar tools, so that it is yet easier to be joined to or detached from the socket 10 by using wrenches or the other similar tools. As a result, by means of joining the socket 20 to the screw-joining portion 13, displaying or selling the socket 20 can be easily achieved.

Figure 5:
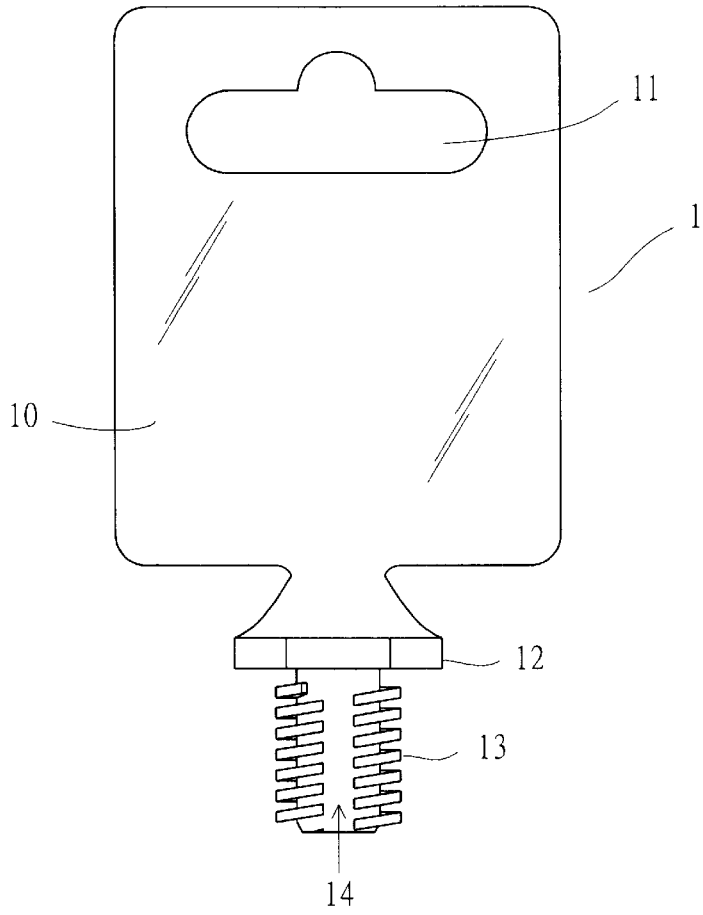
FIG. 5 is a front structural view of the screw-joining portion of the hang tag according to the invention, said screw-joining portion being a gapped structure formed by a set of discontinuous thread.

The screw-thread structure of the screw-joining portion 13 can not only be a structure of continuously threads as shown in FIG. 1, but also a gapped structure of discontinuous threads because the gapped area 14 is installed as shown in FIG. 5.

Figure 6:
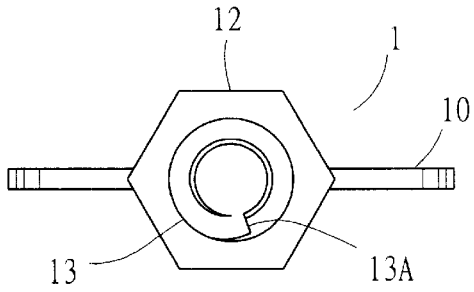
FIG. 6 is a bottom plan view of the screw-joining portion of the hang tag according to this invention, illustrating another embodiment wherein the screw thread of the screw-joining portion is single screw thread.
Figure 7:
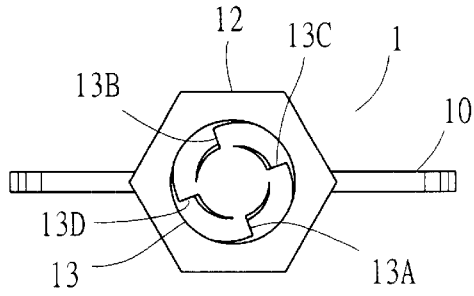
FIG. 7 is a bottom plan structural view of the screw-joining portion of the hang tag according to this invention, illustrating yet another embodiment wherein the screw thread of the screw-joining portion is a quadruple screw thread.

The screw-joining portion 13 not only can be formed of the double screw-thread structure with two starting ends 13A and 13B (as shown in FIG. 2), but also can be formed of single screw-thread structure having a starting end 13A (as shown in FIG. 6), or formed of quadruple screw-thread structure including four screw threads 13A, 13B, 13C and 13D.

Figure 8:
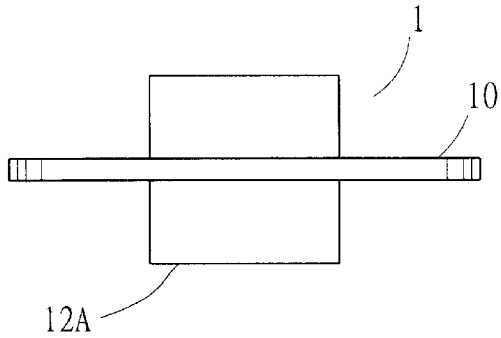
FIG. 8 is a top plan structural view of another embodiment of the hang tag according to this invention, illustrating that the shape of the neck portion is tetragonal.
Figure 9:
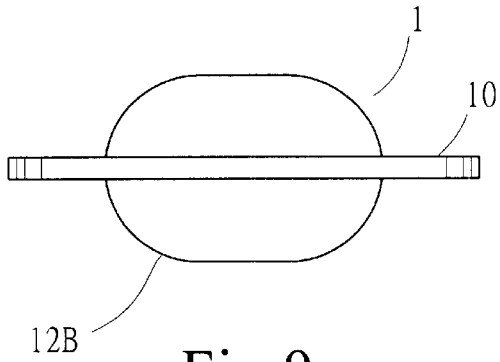
FIG. 9 is a top plan structural view of another embodiment of the hang tag according to this invention, illustrating that the shape of the neck portion is oval.
Figure 10:
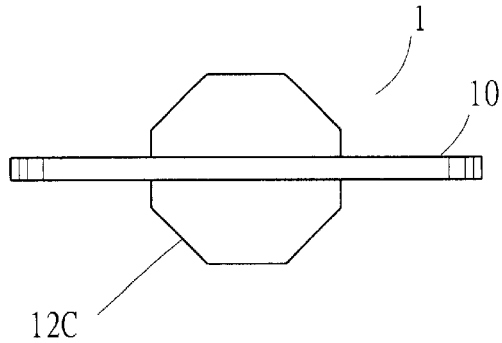
FIG. 10 is a top plan structural view of another embodiment of the hang tag according to this invention, illustrating that the shape of the neck portion is octagonal.
Figure 11:
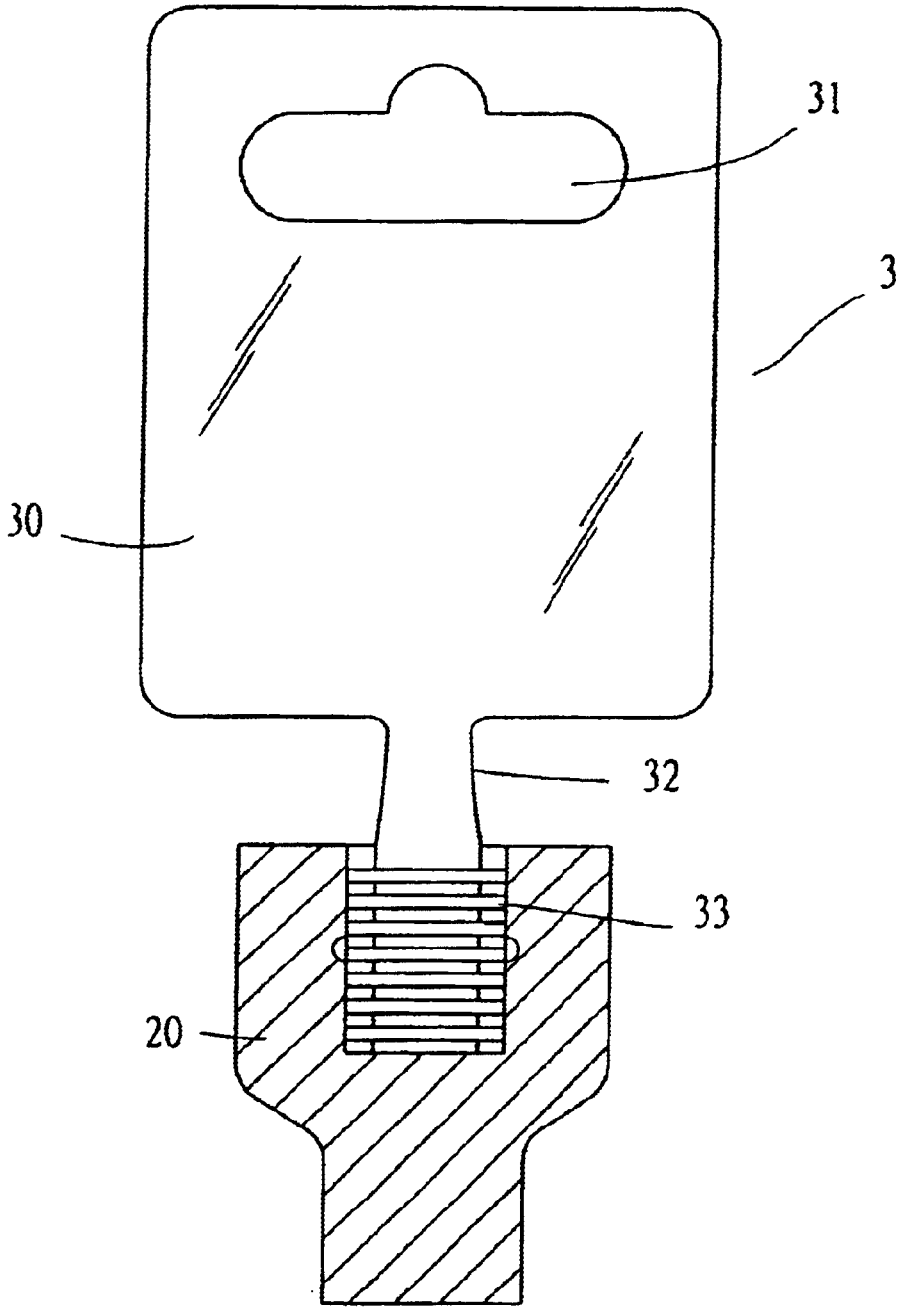
Fig.11 PRIOR ART
FIG. 11 is a front structural view of the conventional hang tag to which the socket is joined.

The neck portion 12 is comprised of at least a pair of parallel sides. The shape of the neck portion 12, besides being hexagonally shaped (as shown in FIG. 2 or FIG. 3), can also be in the shape of quadrangle as the neck portion 12A shown in FIG. 8, and an oval as the neck portion 12B is shown in FIG. 9, or an octagon as the neck portion 12C is shown in FIG. 10. Thus, as the neck portion 12 has at least a pair of parallel sides in various shapes, tools, such as wrenches, can be clamped onto these and operated thereon.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A hang tag for sockets, comprising:

a hanging card portion having a flat planar shape, the hanging card portion comprising a hanging hole, the hang tag is adapted to be hung on a display rack via the hanging hole;

a screw-joining portion comprising a screw-thread structure having external threads adapted to thread onto and out of internal threads of a socket with relative ease; and a neck portion positioned between the hanging card portion and the screw-joining portion, the neck portion comprising at least one pair of parallel sides, the at least one pair of parallel sides is configured for a tool device to clamp thereon to assist in the attachment and detachment of the hanging card portion to a socket.

2. The hang tag for sockets as claimed in claim 1, wherein the screw-thread structure of the screw-joining portion is a double screw-thread structure.

3. The hang tag for sockets as claimed in claim 1, wherein the screw-thread structure of the screw-joining portion is a single screw-thread structure.

4. The hang tag or sockets as claimed in claim 1, wherein the screw-thread structure of the screw-joining portion is a quadruple screw-thread structure.

5. The hang tag for sockets as claimed in claim 1, wherein the screw-thread structure of the screw-joining portion is a continuous-thread structure.

6. The hang tag for sockets as claimed in claim 1, wherein the screw-thread structure of the screw-joining portion is a gapped structure formed of discontinuous threads.

7. The hang tag for sockets as claimed in claim 1, wherein the neck portion is hexagonal in shape.

8. The hang tag for sockets as claimed in claim 1, wherein the neck portion is quadrangular in shape.

9. The hang tag for sockets as claimed in claim 1, wherein the neck portion is octagonal in shape.

10. The hang tag for sockets as claimed in claim 1, wherein the neck portion is oval in shape.

* * * * *